US011587508B2

(12) United States Patent
Kim et al.

(10) Patent No.: US 11,587,508 B2
(45) Date of Patent: Feb. 21, 2023

(54) DISPLAY SYSTEM AND DISPLAY DRIVING APPARATUS THEREOF

(71) Applicant: Silicon Works Co., Ltd., Daejeon (KR)

(72) Inventors: Seong Geon Kim, Daejeon (KR); Young Bok Kim, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/450,413

(22) Filed: Oct. 8, 2021

(65) Prior Publication Data

US 2022/0114966 A1 Apr. 14, 2022

(30) Foreign Application Priority Data

Oct. 8, 2020 (KR) ..... 10-2020-0130192

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0819* (2013.01); *G09G 2310/0294* (2013.01); *G09G 2310/0297* (2013.01); *G09G 2310/08* (2013.01); *G09G 2320/029* (2013.01); *G09G 2320/0295* (2013.01); *G09G 2320/043* (2013.01); *G09G 2320/045* (2013.01); *G09G 2330/028* (2013.01)

(58) Field of Classification Search
CPC ..... G09G 3/3258; G09G 3/3291; G09G 2300/0819; G09G 2310/0294; G09G 2310/0297; G09G 2310/08; G09G 2320/029; G09G 2320/0295; G09G 2320/043; G09G 2320/045; G09G 2330/028
USPC ..... 345/204
See application file for complete search history.

(56) References Cited

U.S. PATENT DOCUMENTS

| | | | | |
|---|---|---|---|---|
| 9,514,686 | B2 * | 12/2016 | Lee | G09G 3/3291 |
| 10,056,032 | B2 * | 8/2018 | Kwon | G09G 3/3233 |
| 10,186,189 | B2 * | 1/2019 | Shin | G09G 3/3225 |
| 11,120,742 | B2 * | 9/2021 | Hwang | G09G 3/3233 |
| 11,282,456 | B2 * | 3/2022 | Piao | G09G 3/3241 |

(Continued)

FOREIGN PATENT DOCUMENTS

| | | | |
|---|---|---|---|
| KR | 10-1549343 | B1 | 9/2015 |
| KR | 2018-0015571 | A | 2/2018 |

(Continued)

*Primary Examiner* — Tom V Sheng
(74) *Attorney, Agent, or Firm* — Polsinelli PC

(57) ABSTRACT

A display driving apparatus includes an internal reference voltage generation circuit configured to generate and provide an internal reference voltage; a sensing circuit configured to simultaneously sense pixel signals provided from pixels of a display panel and the internal reference voltage, and output a reference voltage sensing signal generated by sensing of the internal reference voltage and pixel sensing signals generated by sensing of the pixel signals; and an output circuit configured to sequentially select the reference voltage sensing signal and the pixel sensing signals, convert the pixel sensing signals into pixel data, convert the reference voltage sensing signal into reference data, and transmits the pixel data and the reference data.

15 Claims, 4 Drawing Sheets

(56) References Cited

U.S. PATENT DOCUMENTS

| | | | | |
|---|---|---|---|---|
| 2007/0120780 | A1* | 5/2007 | Park | G09G 3/3291 345/76 |
| 2012/0320098 | A1* | 12/2012 | Kwak | G09G 3/2003 345/690 |
| 2014/0176525 | A1* | 6/2014 | Woo | G09G 3/3233 345/212 |
| 2015/0179107 | A1* | 6/2015 | Kim | G09G 3/3233 345/82 |
| 2016/0155380 | A1* | 6/2016 | Kwon | G09G 3/3233 345/78 |
| 2017/0032738 | A1* | 2/2017 | Lee | G09G 3/3275 |
| 2017/0039953 | A1* | 2/2017 | Lee | G09G 3/3233 |
| 2017/0061877 | A1* | 3/2017 | Lee | H01L 27/3262 |
| 2020/0074925 | A1* | 3/2020 | Lee | G09G 3/3233 |
| 2020/0118485 | A1* | 4/2020 | Choi | G09G 3/3291 |
| 2020/0335024 | A1* | 10/2020 | Kim | G09G 3/20 |
| 2021/0201801 | A1* | 7/2021 | Lee | G09G 3/3258 |
| 2021/0233458 | A1* | 7/2021 | Yang | G09G 3/3225 |

FOREIGN PATENT DOCUMENTS

| | | | |
|---|---|---|---|
| KR | 2018-0049747 | A | 5/2018 |
| KR | 2018-0067152 | A | 6/2018 |
| KR | 2021-0083119 | A | 7/2021 |

* cited by examiner

DISPLAY SYSTEM AND DISPLAY DRIVING APPARATUS THEREOF

BACKGROUND

1. Technical Field

Various embodiments generally relate to a display system, and more particularly, to a display system and a display driving apparatus which sense pixel signals of pixels of a display panel and transmit pixel data corresponding to the pixel signals.

2. Related Art

A display system includes a display panel, a driver and a timing controller.

The driver converts digital display data, provided from the timing controller, into an analog source driving signal, and provides the analog source driving signal to the display panel. The driver is configured by one chip.

The display system may include a plurality of drivers in consideration of the size and resolution of the display panel.

The display panel may have a characteristic deviation between pixels. The characteristic deviation should be corrected. To this end, the driver is configured to generate pixel data corresponding to pixel signals generated by sensing pixel characteristics of pixels and provide the pixel data to the timing controller.

The pixel data provided from the driver to the timing controller may include not only the pixel characteristics but also driver characteristics including electrical characteristics of the driver itself. Therefore, the unnecessary driver characteristics need to be excluded from the pixel data provided to the timing controller.

The gains and offsets of internal circuits of the driver may vary by variations in power supply voltage, temperature, etc., and due to this fact, the driver characteristics may vary. Variations in driver characteristics also need to be excluded from the pixel data.

To this end, the driver may be configured to receive a reference voltage from the outside, generate reference data by sensing the reference voltage and transmit the reference data to the timing controller, and the timing controller may be configured to correct the driver characteristics, that is, errors, included in the pixel data provided from the driver, by the reference data.

However, this method requires that a component for providing the reference voltage to the driver from the outside be added. Therefore, there is a problem in that the manufacturing cost increases.

Also, the above method has a problem in that external noise is introduced into the driver through a path which provides the reference voltage to the inside of the driver from the outside.

SUMMARY

Various embodiments are directed to a display system and a display driving apparatus thereof in which a driver generates an internal reference voltage and reference data for correcting pixel data is generated using the internal reference voltage, thereby capable of reducing the manufacturing cost.

Also, various embodiments are directed to a display system and a display driving apparatus thereof in which reference data for correcting pixel data is generated using a reference voltage generated inside a driver, thereby capable of decreasing introduction of external noise into the driver.

Further, various embodiments are directed to a display system and a display driving apparatus thereof in which an internal reference voltage or an external reference voltage may be selected according to necessity to generate reference data for correcting pixel data, thereby capable of being actively adapted for a system environment.

In addition, various embodiments are directed to a display system and a display driving apparatus thereof in which, in order to generate reference data for correcting pixel data, a master driver uses an internal reference voltage and a slave driver shares the internal reference voltage of the master driver, thereby capable of reducing the manufacturing cost and decreasing introduction of external noise.

In an embodiment, a display driving apparatus may include: an internal reference voltage generation circuit configured to generate and provide an internal reference voltage; a sensing circuit configured to simultaneously sense pixel signals provided from pixels of a display panel and the internal reference voltage, and output a reference voltage sensing signal generated by sensing of the internal reference voltage and pixel sensing signals generated by sensing of the pixel signals; and an output circuit configured to sequentially select the reference voltage sensing signal and the pixel sensing signals, convert the pixel sensing signals into pixel data, convert the reference voltage sensing signal into reference data, and transmit the pixel data and the reference data.

In an embodiment, a display driving apparatus may include: an internal reference voltage generation circuit configured to generate and provide an internal reference voltage; a selection circuit configured to provide a reference voltage by selecting one of an external reference voltage provided from the outside reference voltage and the internal reference voltage; a sensing circuit configured to simultaneously sense pixel signals provided from pixels of a display panel and the reference voltage, and output a reference voltage sensing signal generated by sensing of the reference voltage and pixel sensing signals generated by sensing of the pixel signals; and an output circuit configured to sequentially select the reference voltage sensing signal and the pixel sensing signals, convert the pixel sensing signals into pixel data, convert the reference voltage sensing signal into reference data, and transmit the pixel data and the reference data.

In an embodiment, a display system may include: a master driver configured to generate an internal reference voltage and output the internal reference voltage; and a slave driver configured to receive the internal reference voltage of the master driver, wherein the master driver generates the internal reference voltage, simultaneously senses first pixel signals provided from first pixels of a display panel and the internal reference voltage, converts a first reference voltage sensing signal generated by sensing of the internal reference voltage into first reference data, converts first pixel sensing signals generated by sensing of first pixel signals into first pixel data, and transmits the first reference data and the first pixel data, and wherein the slave driver receives the internal reference voltage, simultaneously senses second pixel signals provided from second pixels of the display panel and the internal reference voltage, converts a second reference voltage sensing signal generated by sensing of the internal reference voltage into second reference data, converts second pixel sensing signals generated by sensing of second pixel signals into second pixel data, and transmits the second reference data and the second pixel data.

According to the embodiments of the present disclosure, an internal reference voltage may be generated inside a driver, and reference data generated by sensing characteristics of the driver using the internal reference voltage may be generated and transmitted.

Therefore, according to the embodiments of the present disclosure, a component for providing an external reference voltage is not needed, and it is not necessary to form a channel for providing the external reference voltage to the inside of the driver. As a result, according to the embodiments of the present disclosure, the manufacturing cost may be reduced, and introduction of external noise may be decreased.

Also, according to the embodiments of the present disclosure, in order to generate reference data for correcting pixel data, an internal reference voltage or an external reference voltage may be selected according to necessity. Therefore, according to the embodiments of the present disclosure, it is possible to be actively adapted to a system environment.

Further, according to the embodiments of the present disclosure, in order to generate reference data for correcting pixel data, an internal reference voltage generated by a master driver among a plurality of drivers may be shared with a slave driver among the plurality of drivers. Therefore, according to the embodiments of the present disclosure, a mismatch in internal reference voltage between drivers may be eliminated, the manufacturing cost may be reduced, and introduction of external noise may be decreased.

DETAILED DESCRIPTION

The present disclosure discloses a display driving apparatus which, in order to eliminate characteristic deviations among pixels of a display panel, outputs pixel data by sensing pixel signals and outputs reference data by sensing an internal reference voltage. Also, the present disclosure discloses a display system including the display driving apparatus described above.

In the present disclosure, the display driving apparatus may be understood as corresponding to a driver to be described later which provides a source driving signal to the display panel in correspondence to display data of a timing controller, and may be configured by one chip.

The above-described display driving apparatus of the present disclosure may have driver characteristics including its own electrical characteristics. The driver characteristics of the display driving apparatus may vary as the gains and offsets of internal circuits vary by variations in power supply voltage, temperature, etc.

The reference data may be used to exclude the driver characteristics from the pixel data, and the pixel data may be used to compensate display data so as to eliminate characteristic deviations among the pixels.

Figure 1:
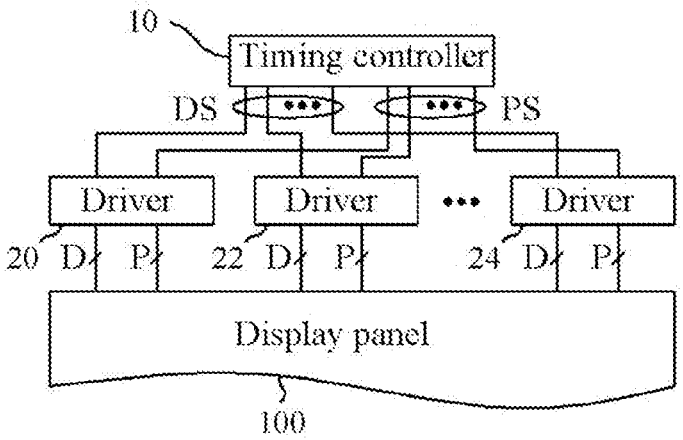
FIG. 1 is a block diagram illustrating a display system in accordance with an embodiment of the present disclosure.

As illustrated in FIG. 1, a display system in accordance with an embodiment of the present disclosure includes a display panel 100, a timing controller 10 and a plurality of drivers 20, 22 and 24.

The display panel 100 may be exemplified as using an organic light emitting diode (OLED) panel.

The display panel 100 includes a pixel array (not illustrated) in which pixels (not illustrated) are arranged in the form of a matrix. For example, the pixel array may include R (red) pixels, G (green) pixels and B (blue) pixels for implementation of colors, and may further include W (white) pixels for luminance.

Each pixel may include a light emitting element (not illustrated) and a pixel circuit (not illustrated). The pixel circuit is configured to supply a current, corresponding to a source driving signal D of the drivers 20, 22 and 24, to the light emitting device. To this end, the pixel circuit may include a driving transistor which provides the current, corresponding to the source driving signal D, to the light emitting element.

Each pixel may have pixel characteristics such as an electrical characteristic deviation of the driving transistor and a degradation deviation of the light emitting element with the lapse of time. As a result, the respective pixels may non-uniformly emit light due to pixel characteristics.

The pixel circuit of each pixel may further include a circuit for sensing pixel characteristics, and may be configured to provide a pixel signal P corresponding to the pixel characteristics.

The pixel signal P may be provided to one of the drivers 20, 22 and 24 corresponding to the pixel. Each of the drivers 20, 22 and 24 is configured to provide sensing data PS, including pixel data corresponding to the pixel signal P, to the timing controller 10.

Pixel characteristics of the pixels may be compensated for by the timing controller 10.

The timing controller 10 is configured to receive display data from an external source, provide display data DS configured as packets to the plurality of drivers 20, 22 and 24 and receive the sensing data PS from each of the drivers 20, 22 and 24.

According to the embodiment of the present disclosure, the sensing data PS includes pixel data and reference data. The pixel data corresponds to the pixel signal P generated by sensing each pixel to compensate for pixel characteristics, and the reference data is to correct errors of the pixel data caused by the driver characteristics of each of the drivers 20, 22 and 24. Detailed description of the pixel data and the reference data will be made later with reference to FIG. 2.

The timing controller 10 may receive the sensing data PS of each of the drivers 20, 22 and 24, may correct driver characteristics, that is, errors, included in the pixel data, by the reference data, and may compensate display data of each of the drivers 20, 22 and 24 by the error-corrected pixel data, thereby compensating for pixel characteristics.

That is to say, the timing controller 10 may compensate the display data, received from the external source, by using the sensing data PS, and may provide compensated display data DS.

Each of the plurality of drivers 20, 22 and 24 is configured by one chip.

In order for display, each of the drivers 20, 22 and 24 is configured to receive the digital display data DS provided from the timing controller 10, generate the analog source driving signal D corresponding to the display data DS, and provide the source driving signal D to each of the pixels of the display panel 100.

In order to compensate for pixel characteristics of the pixels, each of the drivers 20, 22 and 24 is configured to receive the pixel signal P generated by sensing the pixel characteristics of each of the pixels of the display panel 100, and generate the pixel data corresponding to the pixel signal P.

Further, each of the drivers 20, 22 and 24 is configured to generate the reference data for driver characteristics, by using an internal reference voltage.

Each of the drivers 20, 22 and 24 is configured to provide the sensing data PS, including the pixel data and the reference data generated as described above, to the timing controller 10.

Figure 2:
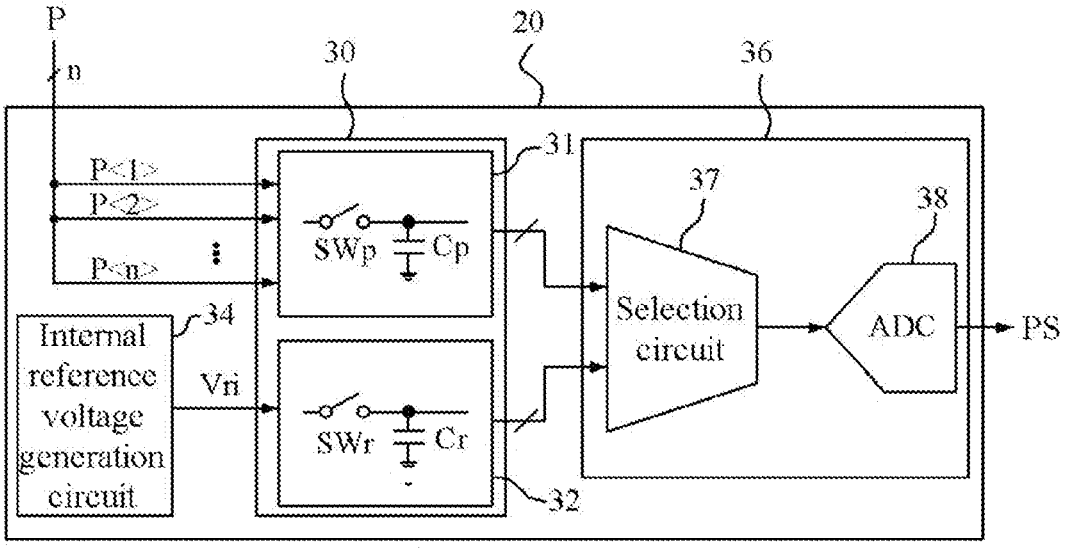
FIG. 2 is a detailed block diagram illustrating a driver of FIG. 1.

Each of the drivers 20, 22 and 24 will be described below with reference to FIG. 2. FIG. 2 representatively illustrates the driver 20, and it may be understood that the drivers 22 and 24 have the same structure as the driver 20 of FIG. 2.

The driver 20 of FIG. 2 is illustrated as including components which receive the pixel signal P, generate the pixel data and the reference data and transmit the sensing data PS including the pixel data and the reference data. For the sake of convenience in explanation, in the driver 20, the illustration of components which convert the display data DS into the source driving signal D will be omitted.

Referring to FIG. 2, the driver 20 includes a sensing circuit 30, an internal reference voltage generation circuit 34 and an output circuit 36.

The internal reference voltage generation circuit 34 may generate and provide an internal reference voltage Vri, and may be configured using a general circuit which generates a bandgap reference voltage. For example, the internal reference voltage generation circuit 34 may generate and output the internal reference voltage Vri of a preset level by using the bandgap reference voltage.

The sensing circuit 30 is configured to receive the pixel signal P from each of the pixels of the display panel 100, receive the internal reference voltage Vri from the internal reference voltage generation circuit 34 and output a reference voltage sensing signal and a pixel sensing signal.

The pixel signal P may be understood as including a plurality of pixel signals, that is, pixel signals P<1>, P<2>, . . . , <Pn>, received from a plurality of pixels corresponding to the driver 20.

The sensing circuit 30 simultaneously senses the plurality of pixel signals P<1>, P<2>, . . . , <Pn>, provided from the plurality of pixels of the display panel 100, and the internal reference voltage Vri. By the sensing, the sensing circuit 30 simultaneously generates pixel sensing signals corresponding to the plurality of pixel signals P<1>, P<2>, . . . , <Pn> and a reference voltage sensing signal corresponding to the internal reference voltage Vri. The sensing circuit 30 is configured to provide the reference voltage sensing signal and the pixel sensing signals which are simultaneously generated, to a selection circuit 37 of the output circuit 36.

To this end, the sensing circuit 30 may include a pixel sensing circuit 31 and a reference voltage sensing circuit 32.

The pixel sensing circuit 31 may sample and hold pixel signals for sensing the pixel signals, and may include switches SWp for sampling and capacitors Cp for holding.

The pixel signals are sampled during a time when the switches SWp are turned on, and the sampled pixel signals are stored and held in the capacitors Cp. Pixel sensing signals which are generated as voltages are held in the capacitors Cp may be provided to the selection circuit 37.

The pixel sensing circuit 31 is configured to simultaneously select the plurality of pixel signals P<1>, P<2>, . . . , <Pn>, simultaneously perform the sampling and holding of the plurality of pixel signals P<1>, P<2>, . . . , <Pn> and simultaneously output the pixel sensing signals which are generated by the sampling and holding of the plurality of pixel signals P<1>, P<2>, . . . , <Pn>.

The reference voltage sensing circuit 32 may sample and hold the internal reference voltage Vri for sensing the internal reference voltage Vri, and may include a switch SWr for sampling and a capacitor Cr for holding.

The internal reference voltage Vri is sampled during a time when the switch SWr is turned on, and the sampled internal reference voltage Vri is stored and held in the capacitor Cr. A reference voltage sensing signal which is generated as a voltage is held in the capacitor Cr may be provided to the selection circuit 37.

The pixel sensing circuit 31 and the reference voltage sensing circuit 32 simultaneously sample the plurality of pixel signals P<1>, P<2>, . . . , <Pn> and the internal reference voltage Vri. In other words, the pixel sensing signals and the reference voltage sensing signal may be generated by being simultaneously sampled and held. Although a control signal for controlling a sampling time point is not illustrated in FIG. 2, the control signal may be provided from the timing controller 10. In this case, the control signal may be provided to the switches SWp of the pixel sensing circuit 31 for sampling the plurality of pixel signals P<1>, P<2>, . . . , <Pn> and the switch SWr of the reference voltage sensing circuit 32 for sampling the internal reference voltage Vri, in such a way to have the same phase.

By the above description, the pixel sensing circuit 31 and the reference voltage sensing circuit 32 are configured to simultaneously sample and hold the plurality of pixel signals P<1>, P<2>, . . . , <Pn> and the internal reference voltage Vri and simultaneously output the pixel sensing signals and the reference voltage sensing signal generated by the sampling and holding.

The output circuit 36 is configured to sequentially select the reference voltage sensing signal and the pixel sensing signals of the sensing circuit 30 which are simultaneously received, convert the pixel sensing signals into pixel data, convert the reference voltage sensing signal into reference data, and transmit sensing data PS including the pixel data and the reference data.

To this end, the output circuit 36 may include the selection circuit 37 and an analog-to-digital converter (ADC) 38.

The selection circuit 37 may be configured by a multiplexer, and sequentially selects the reference voltage sensing signal and the pixel sensing signals of the sensing circuit 30 which are simultaneously received, and provides the sequentially selected reference voltage sensing signal and pixel sensing signals to the analog-to-digital converter (ADC) 38. The selection circuit 37 may perform the selection operation by a control signal for sequentially selecting the reference voltage sensing signal and the pixel sensing signals, and illustration and detailed description of the control signal are be omitted.

The analog-to-digital converter 38 converts the reference voltage sensing signal provided from the selection circuit 37 into the reference data, and converts the pixel sensing signals provided from the selection circuit 37 into the pixel data. The analog-to-digital converter 38 transmits the sensing data PS including the sequentially converted reference data and pixel data.

In the embodiment of the present disclosure implemented as illustrated in FIGS. 1 and 2, an internal reference voltage may be generated in each of the drivers 22, 24 and 26, and reference data generated by sensing characteristics of the driver using the internal reference voltage may be generated and transmitted.

Therefore, according to the embodiment of the present disclosure, a component for providing an external reference voltage is not needed, and it is not necessary to form a channel for providing the external reference voltage to the inside of the driver. Accordingly, the manufacturing cost may be reduced, and the introduction of external noise may be decreased.

Figure 3:
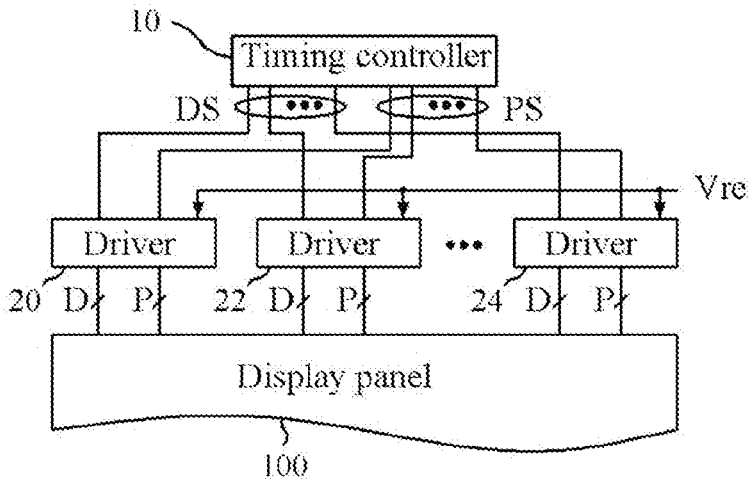
FIG. 3 is a block diagram illustrating a display system in accordance with another embodiment of the present disclosure.
Figure 4:
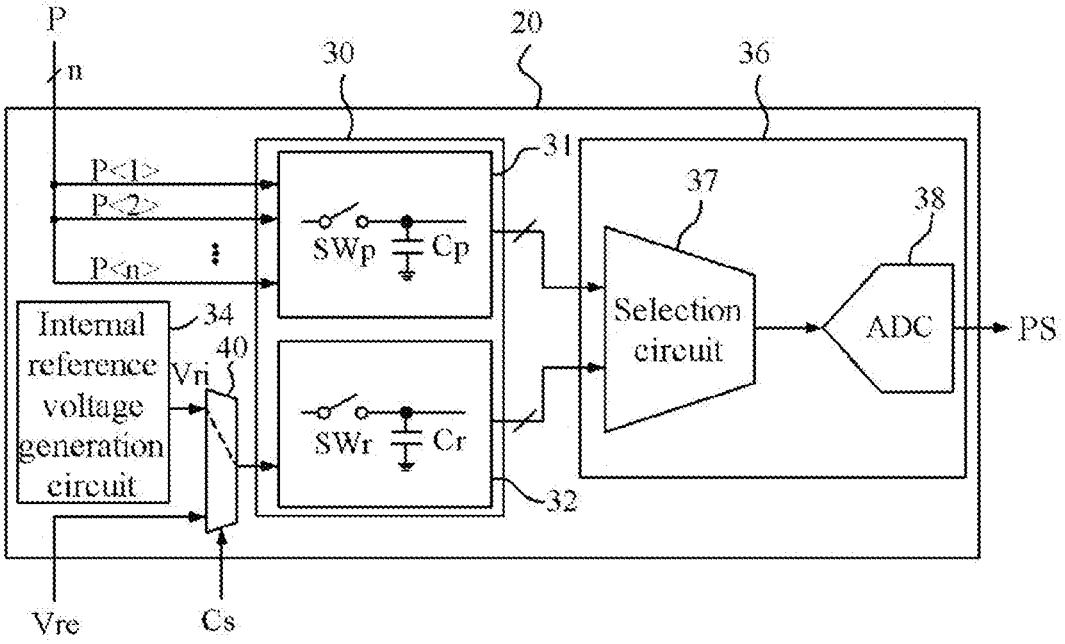
FIG. 4 is a detailed block diagram illustrating a driver of FIG. 3 which selects an internal reference voltage.
Figure 5:
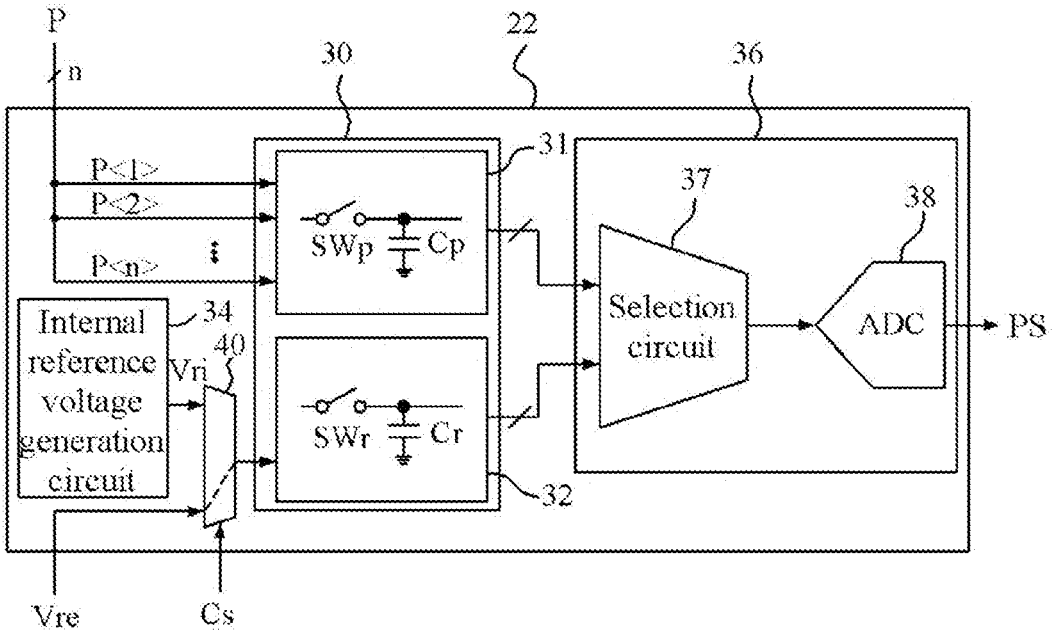
FIG. 5 is a detailed block diagram illustrating a driver of FIG. 3 which selects an external reference voltage.

Meanwhile, as illustrated in FIGS. 3 to 5, embodiments of the present disclosure may be configured to, in order to generate reference data for correcting pixel data, select an internal reference voltage or an external reference voltage according to necessity.

An embodiment of FIG. 3 is configured such that an external reference voltage Vre is provided to the drivers 20, 22 and 24. The configuration of the embodiment of FIG. 3 is the same as that of FIG. 1 except that the external reference voltage Vre is provided to the drivers 20, 22 and 24, and thus, repeated description thereof will be omitted.

The driver 20 of FIG. 3 may be configured to select the internal reference voltage Vri as illustrated in FIG. 4 or select the external reference voltage Vre as illustrated in FIG. 5. The drivers 20, 22 and 24 of FIG. 3 have the same structure. Therefore, the configuration of the driver 20 will be representatively described below with reference to FIGS. 4 and 5, and the structures of the drivers 22 and 24 may be understood by referring to FIGS. 4 and 5.

Referring to FIG. 4, the driver 20 includes a selection circuit 40, and the selection circuit 40 is configured to select one of the external reference voltage Vre provided from the outside reference voltage and the internal reference voltage Vri and provide the selected one as a reference voltage to the reference voltage sensing circuit 32 of the sensing circuit 30.

The driver 20 of FIGS. 4 and 5 has the same structure as the driver 20 of FIG. 2 except that the driver 20 of FIGS. 4 and 5 receives the external reference voltage Vre and includes the selection circuit 40. Thus, description for the detailed configuration and operation of the driver 20 of FIGS. 4 and 5 will be omitted.

The selection circuit 40 may be understood as including a multiplexer.

The selection circuit 40 may receive a selection control signal Cs which is provided from the timing controller 10, and may select the internal reference voltage Vri or the external reference voltage Vre depending on the state of the selection control signal Cs.

Namely, for example, when the selection control signal Cs is provided as a logic high, the selection circuit 40 may select the internal reference voltage Vri and provide the internal reference voltage Vri as a reference voltage to the reference voltage sensing circuit 32 of the sensing circuit 30, as illustrated in FIG. 4. When the selection control signal Cs is provided as a logic low, the selection circuit 40 may select the external reference voltage Vre and provide the external reference voltage Vre as a reference voltage to the reference voltage sensing circuit 32 of the sensing circuit 30, as illustrated in FIG. 5.

The reference voltage sensing circuit 32 receives one of the external reference voltage Vre and the internal reference voltage Vri as a reference voltage, samples and holds the reference voltage, and outputs a reference voltage sensing signal generated by the sampling and holding.

The sampling and holding of the pixel signal sensing circuit 31 and the sampling and holding of the reference voltage of the reference voltage sensing circuit 32 are the same as those in the operation of the driver 20 of FIG. 2, and thus, repeated description will be omitted.

The operation of the output circuit 36 is also the same as that in the operation of the driver 20 of FIG. 2, and thus, repeated description will be omitted.

The embodiment of FIGS. 3 to 5 may, in order to generate reference data for correcting pixel data, select the internal reference voltage Vri or the external reference voltage Vre according to necessity. Therefore, the embodiment of the present disclosure may be actively adapted to a system environment.

Figure 6:
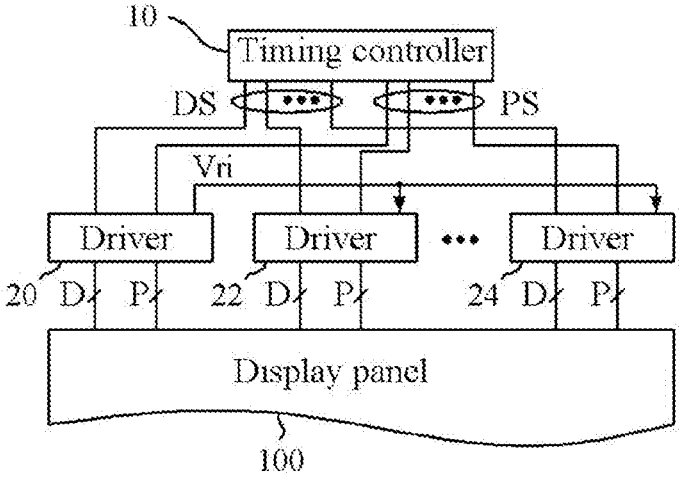
FIG. 6 is a block diagram illustrating a display system in accordance with still another embodiment of the present disclosure.
Figure 7:
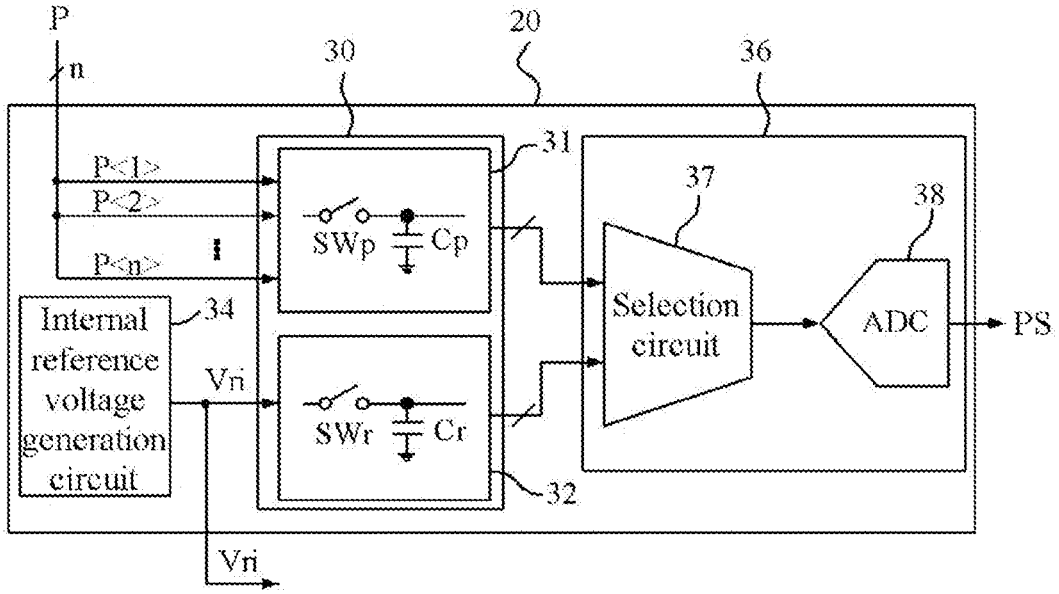
FIG. 7 is a detailed block diagram illustrating a master driver among drivers of FIG. 6.
Figure 8:
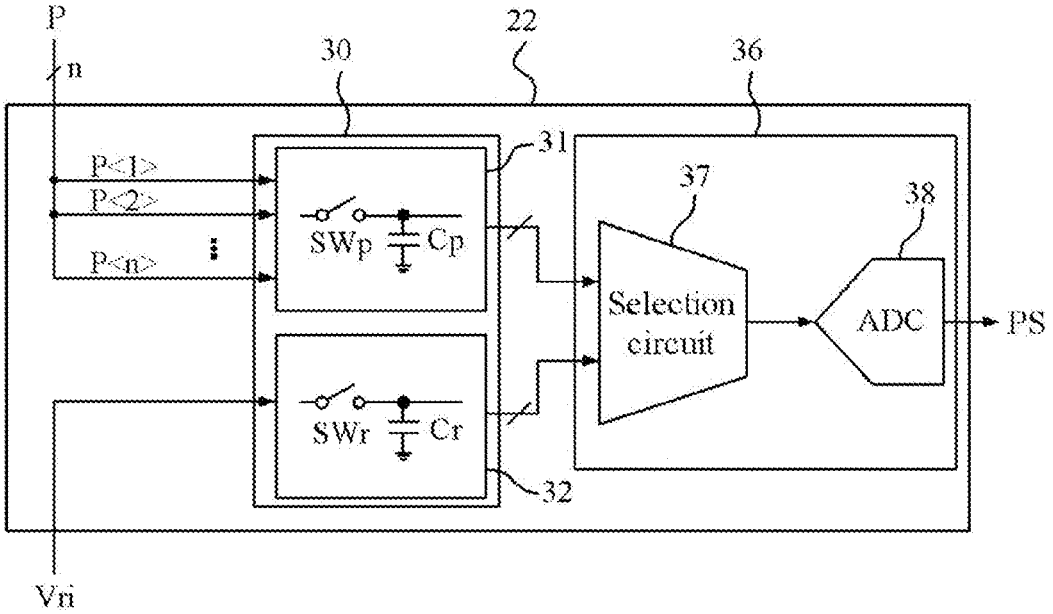
FIG. 8 is a detailed block diagram illustrating a slave driver among the drivers of FIG. 6.

Meanwhile, as illustrated in FIGS. 6 to 8, an embodiment of the present disclosure may be configured to share an internal reference voltage generated by a master driver among a plurality of drivers with a slave driver among the plurality of drivers.

In FIG. 6, the driver 20 is set as a master driver, and the drivers 22 and 24 are set as slave drivers. Hereinafter, the driver 20 is referred to as a master driver, and the drivers 22 and 24 are referred to as slave drivers.

The embodiment of FIG. 6 is configured such that the master driver 20 provides the internal reference voltage Vri to the slave drivers 22 and 24. The embodiment of FIG. 6 is the same as that of FIG. 1 except that the master driver 20 provides the internal reference voltage Vri to the slave drivers 22 and 24, and thus, repeated description thereof will be omitted.

The master driver 20 may be configured as illustrated in FIG. 7, and each of the slave drivers 22 and 24 may be configured as illustrated in FIG. 8.

The master driver 20 of FIG. 7 is different from the driver 20 of FIG. 2 in that the master driver 20 of FIG. 7 provides the internal reference voltage Vri of the internal reference voltage generation circuit 34 to the slave drivers 22 and 24. Except for this, the master driver 20 of FIG. 7 has the same structure as the driver 20 of FIG. 2. Therefore, repeated description for the detailed configuration of the master driver 20 of FIG. 7 will be omitted.

The slave driver 22 of FIG. 8 is different from the driver 20 of FIG. 2 in that the slave driver 22 of FIG. 8 does not have the internal reference voltage generation circuit 34 and the internal reference voltage Vri of the master driver 20 is provided to the reference voltage sensing circuit 32. Except for this, the slave driver 22 of FIG. 8 has the same structure as the driver 20 of FIG. 2. Therefore, repeated description for the detailed configuration of the slave driver 22 of FIG. 8 will be omitted.

According to the embodiment of FIGS. 6 to 8, the master driver 20 generates reference data by sensing driver characteristics using the internal reference voltage Vri. Each of the slave drivers 22 and 24 generates reference data by sensing driver characteristics by using the internal reference voltage Vri of the master driver 20.

The configuration of FIGS. 6 to 8 shares the internal reference voltage Vri of the master driver 20, and thus, it is possible to solve the problem caused due to the mismatch of the internal reference voltage Vri among the drivers 20, 22 and 24.

In the configuration of FIGS. 6 to 8, each of the slave drivers 22 and 24 does not include the internal reference voltage generation circuit 34, and thus, in correspondence thereto, may have an advantage in terms of chip size.

Therefore, according to the embodiment of the present disclosure implemented as illustrated in FIGS. 6 to 8, the manufacturing cost may be reduced, and introduction of external noise may be decreased.

What is claimed is:

1. A display driving apparatus comprising:

an internal reference voltage generation circuit configured to generate and provide an internal reference voltage;

a sensing circuit configured to simultaneously sense pixel signals provided from pixels of a column of a display panel and the internal reference voltage, and output a reference voltage sensing signal generated by sensing of the internal reference voltage and pixel sensing signals generated by sensing of the pixel signals; and an output circuit configured to sequentially select the reference voltage sensing signal and the pixel sensing signals, convert the pixel sensing signals into pixel data, convert the reference voltage sensing signal into reference data, and transmit the pixel data and the reference data.

2. The display driving apparatus according to claim 1, wherein the internal reference voltage generation circuit generates the internal reference voltage using a bandgap reference voltage.

3. The display driving apparatus according to claim 1, wherein the sensing circuit simultaneously senses the plurality of pixel signals provided from the plurality of pixels of the display panel and the internal reference voltage, and outputs the reference voltage sensing signal and the pixel sensing signals which are simultaneously generated by sensing.

4. The display driving apparatus according to claim 1, wherein the sensing circuit comprises:

a pixel signal sensing circuit configured to simultaneously sample and hold the pixel signals for sensing of the pixel signals, and output the pixel sensing signals which are generated by sampling and holding; and a reference voltage sensing circuit configured to sample and hold the internal reference voltage for sensing of the internal reference voltage, and output the reference voltage sensing signal which is generated by sampling and holding, wherein the pixel sensing signals and the reference voltage sensing signal are simultaneously sampled.

5. The display driving apparatus according to claim 4, wherein the pixel signal sensing circuit and the reference voltage sensing circuit comprise switches for sampling of the pixel signals and the internal reference voltage and capacitors for holding of the pixel signals and the internal reference voltage, and the switches of the pixel signal sensing circuit and the reference voltage sensing circuit are turned on at the same time point for sampling.

6. A display driving apparatus comprising:

an internal reference voltage generation circuit configured to generate and provide an internal reference voltage;

a selection circuit configured to provide a reference voltage by selecting one of an external reference voltage provided from the outside reference voltage and the internal reference voltage;

a sensing circuit configured to simultaneously sense pixel signals provided from pixels of a column of a display panel and the reference voltage, and output a reference voltage sensing signal generated by sensing of the reference voltage and pixel sensing signals generated by sensing of the pixel signals; and an output circuit configured to sequentially select the reference voltage sensing signal and the pixel sensing signals, convert the pixel sensing signals into pixel data, convert the reference voltage sensing signal into reference data, and transmit the pixel data and the reference data.

7. The display driving apparatus according to claim 6, wherein the selection circuit comprises a multiplexer which receives a selection control signal provided from a timing controller and outputs the reference voltage by selecting one of the external reference voltage and the internal reference voltage by the selection control signal.

8. The display driving apparatus according to claim 6, wherein the sensing circuit simultaneously senses the plurality of pixel signals provided from the plurality of pixels of the display panel and the reference voltage, and outputs the reference voltage sensing signal and the pixel sensing signals which are simultaneously generated by sensing.

9. The display driving apparatus according to claim 6, wherein the sensing circuit comprises:

a pixel signal sensing circuit configured to sample and hold the pixel signals for sensing of the pixel signals, and output the pixel sensing signals which are generated by sampling and holding; and a reference voltage sensing circuit configured to sample and hold the reference voltage for sensing of the reference voltage, and output the reference voltage sensing signal which is generated by sampling and holding, wherein the pixel sensing signals and the reference voltage sensing signal are simultaneously sampled.

10. The display driving apparatus according to claim 9, wherein the pixel signal sensing circuit and the reference voltage sensing circuit comprise switches for sampling and capacitors for holding, and the switches of the pixel signal sensing circuit and the reference voltage sensing circuit are turned on at the same time point for sampling.

11. A display system comprising:

a master driver configured to generate an internal reference voltage and output the internal reference voltage; and a slave driver configured to receive the internal reference voltage of the master driver, wherein the master driver generates the internal reference voltage, simultaneously senses first pixel signals provided from a column of first pixels of a display panel and the internal reference voltage, converts a first reference voltage sensing signal generated by sensing of the internal reference voltage into first reference data, converts first pixel sensing signals generated by sensing of first pixel signals into first pixel data, and transmits the first reference data and the first pixel data, and wherein the slave driver receives the internal reference voltage, simultaneously senses second pixel signals provided from a column of second pixels of the display panel and the internal reference voltage, converts a second reference voltage sensing signal generated by sensing of the internal reference voltage into second reference data, converts second pixel sensing signals generated by sensing of second pixel signals into second pixel data, and transmits the second reference data and the second pixel data.

12. The display system according to claim 11, wherein the master driver comprises:

an internal reference voltage generation circuit configured to generate and provide the internal reference voltage;

a first sensing circuit configured to simultaneously sense the first pixel signals provided from the first pixels of the display panel and the internal reference voltage, and output the first reference voltage sensing signal generated by sensing of the internal reference voltage and the first pixel sensing signals generated by sensing of the first pixel signals; and a first output circuit configured to sequentially select the first reference voltage sensing signal and the first pixel sensing signals, convert the first pixel sensing signals into first pixel data, convert the first reference voltage sensing signal into first reference data, and transmit the first pixel data and the first reference data.

13. The display system according to claim 12, wherein the first sensing circuit comprises:

a first pixel signal sensing circuit configured to sample and hold the first pixel signals for sensing of the first pixel signals, and output the first pixel sensing signals which are generated by sampling and holding; and a first reference voltage sensing circuit configured to sample and hold the internal reference voltage for sensing of the internal reference voltage, and output the first reference voltage sensing signal which is generated by sampling and holding, wherein the first pixel sensing signals and the first reference voltage sensing signal are simultaneously sampled.

14. The display system according to claim 11, wherein the slave driver comprises:

a second sensing circuit configured to simultaneously sense the second pixel signals provided from the second pixels of the display panel and the internal reference voltage, and output the second reference voltage sensing signal generated by sensing of the internal reference voltage and the second pixel sensing signals generated by sensing of the second pixel signals; and a second output circuit configured to sequentially select the second reference voltage sensing signal and the second pixel sensing signals, convert the second pixel sensing signals into second pixel data, convert the second reference voltage sensing signal into second reference data, and transmit the second pixel data and the second reference data.

15. The display system according to claim 14, wherein the second sensing circuit comprises:

a second pixel signal sensing circuit configured to sample and hold the second pixel signals for sensing of the second pixel signals, and output the second pixel sensing signals which are generated by sampling and holding; and a second reference voltage sensing circuit configured to sample and hold the internal reference voltage for sensing of the internal reference voltage, and output the second reference voltage sensing signal which is generated by sampling and holding, wherein the second pixel sensing signals and the second reference voltage sensing signal are simultaneously sampled.

* * * * *